US008509454B2

(12) United States Patent
Kirkeby et al.

(10) Patent No.: US 8,509,454 B2
(45) Date of Patent: Aug. 13, 2013

(54) FOCUSING ON A PORTION OF AN AUDIO SCENE FOR AN AUDIO SIGNAL

(75) Inventors: Ole Kirkeby, Espoo (FI); Jussi Virolainen, Espoo (FI)

(73) Assignee: Nokia Corporation, Espoo (FI)

( * ) Notice: Subject to any disclaimer, the term of this patent is extended or adjusted under 35 U.S.C. 154(b) by 1082 days.

(21) Appl. No.: 11/933,638

(22) Filed: Nov. 1, 2007

(65) Prior Publication Data

US 2009/0116652 A1 May 7, 2009

(51) Int. Cl.
*H04R 3/00* (2006.01)

(52) U.S. Cl.
USPC ..... 381/92; 381/310

(58) Field of Classification Search
USPC ..... 381/310, 17, 106, 309, 1, 92; 700/94; 379/202.01; 348/14.8
See application file for complete search history.

(56) References Cited

U.S. PATENT DOCUMENTS

| | | | | |
|---|---|---|---|---|
| 4,860,366 | A | 8/1989 | Fukushi et al. | |
| 5,940,118 | A | 8/1999 | Van Schyndel | |
| 6,405,163 | B1 | 6/2002 | Laroche | |
| 6,771,778 | B2 | 8/2004 | Kirkeby | |
| 2003/0007648 | A1 | 1/2003 | Currell | |
| 2003/0053680 | A1 | 3/2003 | Lin et al. | |
| 2004/0037436 | A1 | 2/2004 | Rui | |
| 2004/0196982 | A1 * | 10/2004 | Aylward et al. | 381/17 |
| 2007/0041592 | A1 | 2/2007 | Avendano et al. | |
| 2007/0050441 | A1 | 3/2007 | Taenzer et al. | |
| 2007/0127753 | A1 | 6/2007 | Feng et al. | |
| 2007/0213858 | A1 * | 9/2007 | Hatano | 700/94 |
| 2009/0060208 | A1 * | 3/2009 | Pan et al. | 381/17 |
| 2009/0092259 | A1 * | 4/2009 | Jot et al. | 381/17 |

FOREIGN PATENT DOCUMENTS

WO 2004077884 A1 9/2004

OTHER PUBLICATIONS

International Search Report for PCT/IB2008/002909, dated Mar. 19, 2009, pp. 1-4.
International Preliminary Report on Patentability for related application PCT/IB2008/002909, dated May 4, 2010, pp. 1-7.
Blauert, Jens. Spatial Hearing: The Psychophysics of Human Sound Localization, 1997, The MIT Press, USA.
Julstrom, Stephen, "A High-Performance Surround Sound Process for Home Video," Journal of the Audio Engineering Society, Jul./Aug. 1987, pp. 536-549, vol. 35, No. 7/8, USA.
Gerzon, Michael A., "Optimum Reproduction Matrices for Multispeaker Stereo," Journal of the Audio Engineering Society, Jul./Aug. 1992, pp. 571-589, vol. 40, No. 7/8, USA.

(Continued)

*Primary Examiner* — Alexander Jamal
(74) *Attorney, Agent, or Firm* — Banner & Witcoff, Ltd.

(57) ABSTRACT

Aspects of the invention provide methods, computer-readable media, and apparatuses for spatially manipulating sound that is played back to a listener over a set of output transducers, e.g., headphones. The listener can direct spatial attention to focus on a portion of an audio scene, analogous to a magnifying glass being used to pick out details in a picture. An input multi-channel audio signal that is generated by audio sources is obtained, and directional information is determined for each of the audio sources. The user provides a desired direction of spatial attention so that audio processing can focus on the desired direction and render a corresponding multi-channel audio signal to the user. A region of an audio scene is expanded around the desired direction while the audio scene is compressed in another portion of the audio scene.

22 Claims, 12 Drawing Sheets

(56) References Cited

OTHER PUBLICATIONS

Griesinger, David, "Multichannel Matrix Surround Decoders for Two-Eared Listeners," Audio Engineering Society 101st Convention, Preprint, 1996, pp. 1-22, USA.
Irwan, R. "Two-to-Five Channel Sound Processing," Audio Engineering Society, 2002, pp. 914-926, vol. 50, No. 11, USA.
Li, Yan, "An Unsupervised Adaptive Filtering Approach of 2-to-5 Channel Upmix," Audio Engineering Society, 2005, pp. 1-7, USA.
Avendano, Carlos, "Frequency-Domain Techniques for Stereo to Multichannel Upmix," Audio Engineering Society, International Conference on Virtual, Synthetic and Entertainment Audio, 2002, pp. 1-10, Finland.
Jot, Jean-Marc, "Spatial Enhancement of Audio Recordings," AES 23rd International Conference, 2003, pp. 1-11, Denmark.
Elen, R. "Ambisonic.net" <http://www.ambisonic.net/>, 1998, pp. 1-27, USA.
University of York, "Sound in Space," Music Technology Group, 2004, pp. 1-2, England.
Malham D. G., "Spatial Hearing Mechanisms and Sound Reproduction," University of York, Music Technology Group 1998, pp. 1-12, England.
Merimaa, Juha, "Spatial Impulse Response Rendering I: Analysis and Synthesis," Audio Engineering Society, 2005, vol. 53, No. 12, pp. 1115-1127, USA.
Pulkki, Ville, "Spatial Impulse Repsonse Rendering II: Reproduction of Diffuse Sound and Listening Tests," Audio Engineering Society, 2006, vol. 54, No. 1/2, pp. 3-18, USA.
Pulkki, Ville, "Spatial Impulse Response Rendering: Listening Tests and Applications to Continuous Sound," Audio Engineering Society, 2005, pp. 1-13, Spain.
Pulkii, Ville, "Directional Audio Coding: Filterbank and STFT-based Design," Audio Engineering Society Convention Paper, 2006, pp. 1-12, France.
Pulkii, Ville, "Directional Audio Coding in Spatial Sound Reproduction and Stereo Upmixing," Audio Engineering Society 28th International Conference, 2006, pp. 1-8, Sweden.
Pulkii, Ville et al. "Analysing Virtual Sound Source Attributes Using a Binaural Auditory Model," Journal of the Audio Engineering Society, 1999, pp. 203-218, USA.
Billinghurst, Mark et al. "Motion-Tracking in Spatial Mobile Audio-Conferencing," Mobile HCI '07, 2007, pp. 1-4, Singapore.
Second Office Action in CN200880113925.X dated Jan. 5, 2013.
Office Action in CN 200880113925.X dated Jun. 1, 2012.

* cited by examiner abcdefghijklmnopqrstuvwxyz

FOCUSING ON A PORTION OF AN AUDIO SCENE FOR AN AUDIO SIGNAL

FIELD OF THE INVENTION

The present invention relates to processing a multi-channel audio signal in order to focus on an audio scene.

BACKGROUND OF THE INVENTION

With continued globalization, teleconferencing is becoming increasing important for effective communications over multiple geographical locations. A conference call may include participants located in different company buildings of an industrial campus, different cities in the United States, or different countries throughout the world. Consequently, it is important that spatialized audio signals are combined to facilitate communications among the participants of the teleconference.

Spatial attention processing typically relies on applying an upmix algorithm or a repanning algorithm. With teleconferencing it is possible to move the active speech source closer to the listener by using 3D audio processing or by amplifying the signal when only one channel is available for the playback. The processing typically takes place in the conference mixer which detects the active talker and processes this voice accordingly.

Visual and auditory representations can be combined in 3D audio teleconferencing. The visual representation, which can use the display of a mobile device, can show a table with the conference participants as positioned figures. The voice of a participant on the right side of the table is then heard from the right side over the headphones. The user can reposition the figures of the participants on the screen and, in this way, can also change the corresponding direction of the sound. For example, if the user moves the figure of a participant who is at the right side, across to the center, then the voice of the participant also moves from the right to the center. This capability gives the user an interactive way to modify the auditory presentation.

Spatial hearing, as well as the derived subject of reproducing 3D sound over headphones, may be applied to processing audio teleconferencing. Binaural technology reproduces the same sound at the listener's eardrums as the sound that would have been produced there by an actual acoustic source. Typically, there are two main applications of binaural technology. One is for virtualizing static sources such as the left and right channels in a stereo music recording. The other is for virtualizing, in real-time, moving sources according to the actions of the user, which is the case for games, or according to the specifications of a pre-defined script, which is the case for 3D ringing tones.

Consequently, there is a real market need to provide effective teleconferencing capability of spatialized audio signals that can be practically implemented by a teleconferencing system.

SUMMARY

An aspect of the present invention provides methods, computer-readable media, and apparatuses for spatially manipulating sound that is played back to a listener over headphones. The listener can direct spatial attention to a part of the sound stage analogous to a magnifying glass being used to pick out details in a picture. Focusing on an audio scene is useful in applications such as teleconferencing, where several people, or even several groups of people, are positioned in a virtual environment around the listener. In addition to the specific example of teleconferencing, the invention can often be used when spatial audio is an important part of the user experience. Consequently, the invention can also be applied to stereo music and 3D audio for games.

With aspects of the invention, headtracking may be incorporated in order to stabilize the audio scene relative to the environment. Headtracking enables a listener to hear the remote participants in a teleconference call at fixed positions relative to the environment regardless of the listener's head orientation.

With another aspect of the invention, an input multi-channel audio signal that is generated by a plurality of audio sources is obtained, and directional information is determined for each of the audio sources. The user provides a desired direction of spatial attention so that audio processing can focus on the desired direction and render a corresponding multi-channel audio signal to the user.

With another aspect of the invention, a region of an audio scene is expanded around the desired direction while the audio scene is compressed in another portion of the audio scene and a third region is left unmodified. One region may be comprised of several disjointed spatial sections.

With another aspect of the invention, input azimuth values of an audio scene are re-mapped to output azimuth values, where the output azimuth values are different from the input azimuth values. A non-linear re-mapping function may be used to re-map the azimuth values.

BRIEF DESCRIPTION OF THE DRAWINGS

A more complete understanding of the present invention and the advantages thereof may be acquired by referring to the following description in consideration of the accompanying drawings, in which like reference numbers indicate like features and wherein.

DETAILED DESCRIPTION OF THE INVENTION

Figure 1A:
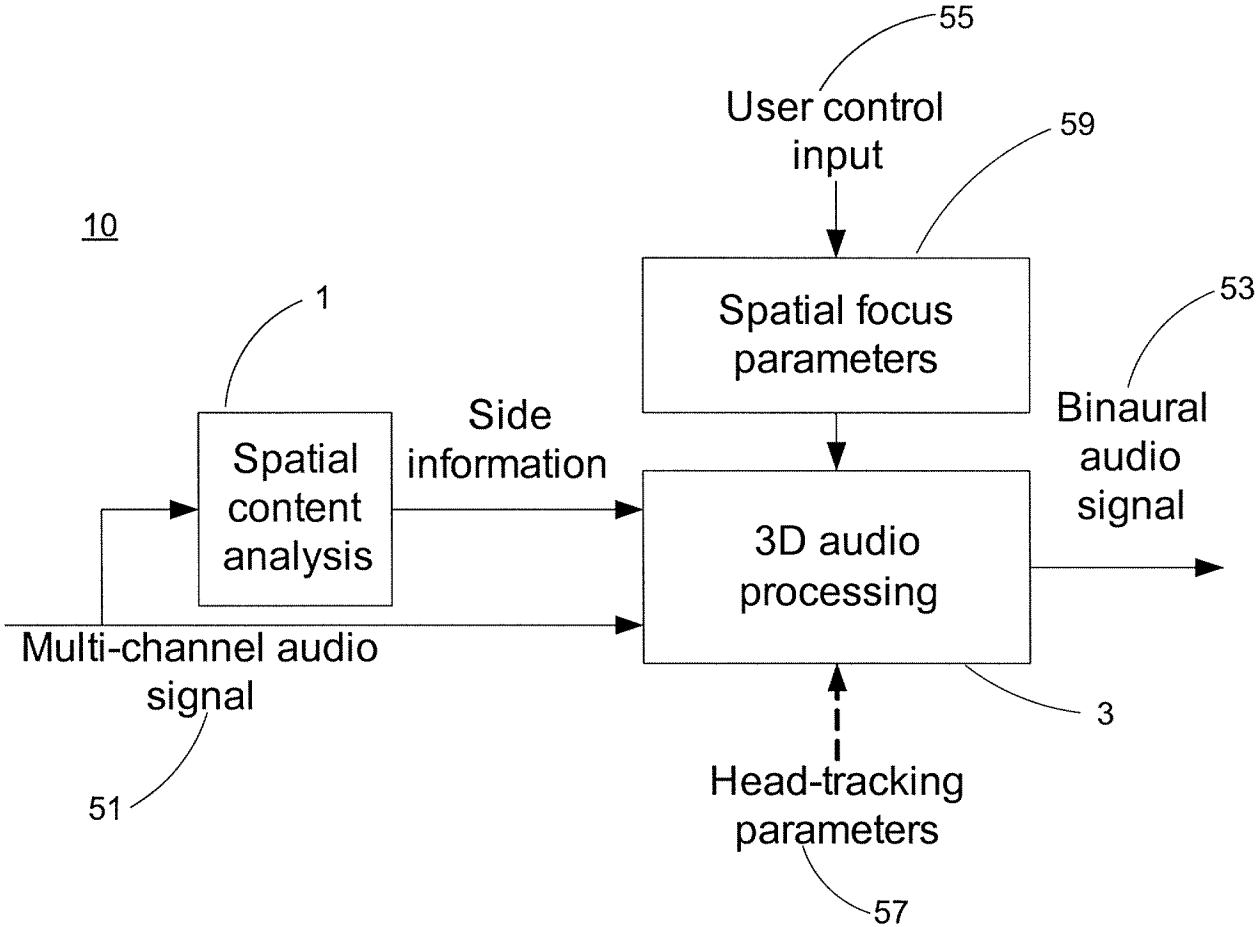
FIG. 1A shows an architecture for focusing on a portion of an audio scene for a multi-channel audio signal according to an embodiment of the invention.

In the following description of the various embodiments, reference is made to the accompanying drawings which form a part hereof, and in which is shown by way of illustration various embodiments in which the invention may be practiced. It is to be understood that other embodiments may be utilized and structural and functional modifications may be made without departing from the scope of the present invention.

As will be further discussed, embodiments of the invention may support the re-panning multiple audio (sound) signals by applying spatial cue coding. Sound sources in each of the signals may be re-panned before the signals are mixed to a combined signal. For example, processing may be applied in a conference bridge that receives two omni-directionally recorded (or synthesized) sound field signals as will be further discussed. The conference bridge subsequently re-pans one of the signals to the listeners left side and the signal to the right side. The source image mapping and panning may further be adaptively based on the content and use case. Mapping may be done by manipulating the directional parameters prior to directional decoding or before directional mixing.

As will be further discussed, embodiments of the invention support a signal format that is agnostic to the transducer system used in reproduction. Consequently, a processed signal may be played through headphones and different loudspeaker setups.

The human auditory system has an ability to separate streams according to their spatial characteristics. This ability is often referred to as the "cocktail-party effect" because it can readily be demonstrated by a phenomenon we are all familiar with. In a noisy crowded room at a party it is possible to have a conversation because the listener can focus the attention on the person speaking, and in effect filter out the sound that comes from other directions. Consequently, the task of concentrating on a particular sound source is made easier if the sound source is well separated spatially from other sounds and also if the sound source of interest is the loudest.

FIG. 1 shows architecture 10 for focusing on a portion of an audio scene for multi-channel audio signal 51 according to an embodiment of the invention. A listener (not shown) can focus on a desired sound source (focusing spatial attention on a selected part of a sound scene) by listening to binaural audio signal 53 through headphones (not shown) or another set of transducers (e.g., audio loudspeakers). Embodiments of the invention also support synthesizing a processed multi-channel audio signal with more than two transducers. Spatial focusing is implemented by using 3D audio technology corresponding to spatial content analysis module 1 and 3D audio processing module 3 as will be further discussed.

Architecture 10 provides spatial manipulation of sound that may be played back to a listener over headphones. The listener can direct spatial attention to a part of the sound stage in a way similar to how a magnifying glass can be used to pick out details in a picture. Focusing may be useful in applications such as teleconferencing, where several people, or even several groups of people, are positioned in a virtual environment around the listener. In addition to teleconferencing, architecture 10 may be used when spatial audio is an important part of the user experience. Consequently, architecture 10 may be applied to stereo music and 3D audio for games.

Architecture 10 may incorporate headtracking for stabilizing the audio scene relative to the environment. Headtracking enables a listener to hear the remote participants in a teleconference call at fixed positions relative to the environment regardless of the listener's head orientation.

There are often situations in speech communication where a listener might want to focus on a certain person talking while simultaneously suppressing other sounds. In real world situations, this is possible to some extent if the listener can move closer to the person talking. With 3D audio processing (corresponding to 3D audio processing module 3) this effect may be exaggerated by implementing a "supernatural" focus of spatial attention that not only makes the selected part of the sound stage louder but that can also manipulate the sound stage spatially so that the selected portion of an audio scene stands out more clearly.

The desired part of the sound scene can be one particular person talking among several others in a teleconference, or vocal performers in a music track. If a headtracker is available, the user (listener) only has to turn one's head in order to control the desired direction of spatial focus to provide headtracking parameters 57. Alternatively, spatial focus parameters 59 may be provided by user control input 55 through an input device, e.g., keypad or joystick.

Multi-channel audio signal 51 may be a set of independent signals, such as a number of speech inputs in a teleconference call, or a set of signals that contain spatial information regarding the relationship to each other, e.g., as in the Ambisonics B-format. Stereo music and binaural content are examples of two-channel signals that contain spatial information. In the case of stereo music, as well as recordings made with microphone arrays, spatial content analysis (corresponding to spatial content analysis module 1) is necessary before a spatial manipulation of the sound stage can be performed. One approach is DirAC (as will be discussed with FIGS. 3 and 4). A special case of the full DirAC analysis is center channel extraction from two-channel signals which is useful for stereo music.

Figure 1B:
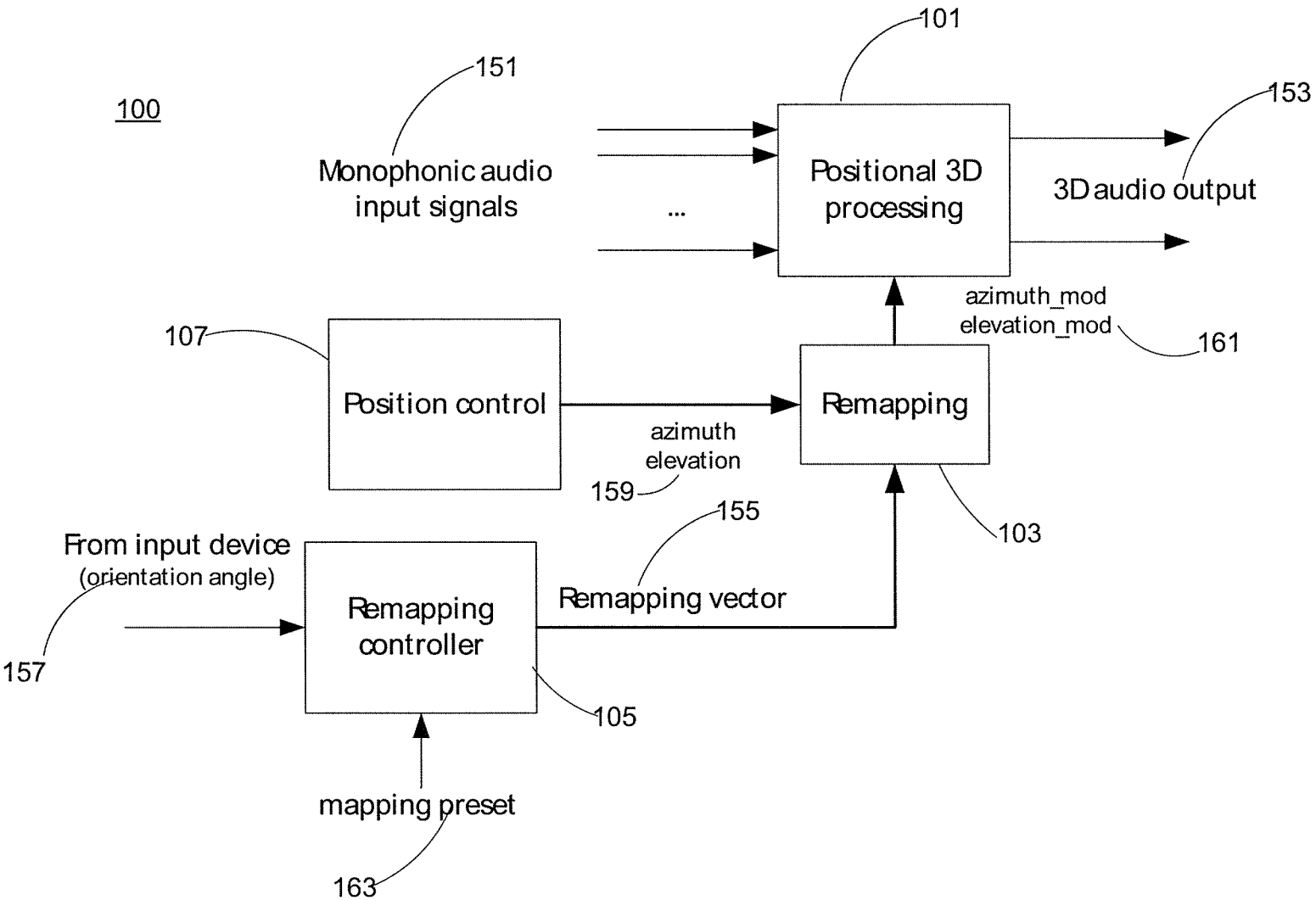
FIG. 1B shows a second architecture for focusing on a portion of an audio scene for a multi-channel audio signal according to an embodiment of the invention.

FIG. 1B shows architecture 100 for focusing on a portion of an audio scene for multi-channel audio signal 151 according to an embodiment of the invention. Processing module 101 provides audio output 153 in accordance with modified parameters 163 in order to focus on an audio scene.

Figure 8:
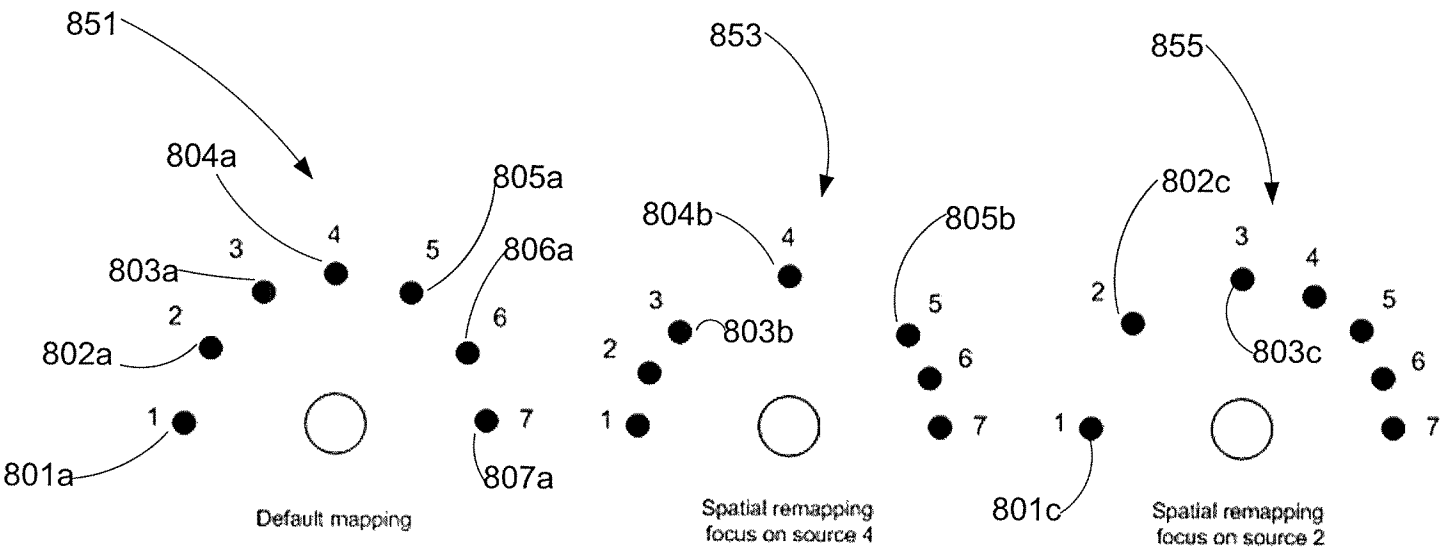
FIG. 8 shows scenarios for focusing on an acoustic source according to an embodiment of the invention.

Sound source position parameters 159 (azimuth, elevation, distance) are replaced with modified values 161. Remapping module 103 modifies azimuth and elevation according to remapping function or a vector 155 that effectively defines the value of a function at a number of discrete points. Remapping controller 105 determines remapping function/vector 155 from orientation angle 157 and mapping preset input 163 as will be discussed. Position control module 107 controls the 3D positioning of each sound source, or channel. For example, in a conferencing system, module 107 defines positions at which the voices of the participants are located, as illustrated in FIG. 8. Positioning may be automatic or it can be controlled by the user.

An exemplary embodiment may perform in a terminal that supports a decentralized 3D teleconferencing system. The terminal receives monophonic audio signals from all the other participating terminals and spatializes the audio signals locally.

Remapping function/vector 155 defines the mapping from an input parameter value set to an output parameter value set. For example, a single input azimuth value may be mapped to new azimuth value (e.g., 10 degrees→15 degrees) or a range of input azimuth values may be mapped linearly (or nonlinearly) to another range of azimuth values (e.g. 0-90 degrees→0-45 degrees).

One possible format of repanning operation is as a mapping from the input azimuth values to the output azimuth values. As an example, if one defines a sigmoid remapping function R(v) of the type $$R(v) = k1 \cdot \left(\frac{360}{1 + e^{-k2 \cdot v}} - 180\right) \quad (1)$$

where v is an azimuth angle between plus and minus 180 degrees, k1 and k2 are appropriately chosen positive constants, then sources clustered around the angle zero are expanded and sources clustered around plus and minus 180 degrees are compressed. For a value of k1 of 1.0562 and k2 of 0.02, a list of pairs of corresponding input-output azimuths is given below (output values are rounded to nearest degree) as shown in Table 1.

TABLE 1

| Input | −180 | −150 | −120 | −90 | −60 | −30 | 0 | 30 | 60 | 90 | 120 | 150 | 180 |
|---|---|---|---|---|---|---|---|---|---|---|---|---|---|
| Output | −180 | −172 | −158 | −136 | −102 | −55 | 0 | 55 | 102 | 136 | 158 | 172 | 180 |

An approximation to the mapping function description may be made by defining a mapping vector. The vector defines the value of the mapping function at discrete points. If an input value is between these discrete points, linear interpolation or some other interpolation method can be used to interpolate values between these points. Example of mapping vector would be the "Output" row in Table 1. The vector has a resolution of 30 degrees and defines the values of the output azimuth at discrete points for certain input azimuth values. Using a vector representation the mapping can be implemented in a simple way as a combination of table look-up and optional interpolation operations.

A new mapping function (or vector) 155 is generated when control signal defining the spatial focus direction (orientation angle) or mapping preset 163 is changed. A change of input signal 157 obtained from the input device (e.g., joystick) results in the generation of new remapping function/vector 155. An exemplary real-time modification may be a rotation operation. When the focus is set by the user for a different direction, the remapping vector is modified accordingly. A change of orientation angle can be implemented by adding an angle v0 to the result of the remapping function R(v) and projecting the sum on the range from −180 to 180 modulo 360. For example, if R(v) is 150 and v0 is 70, then the new remapped angle is −140 because 70 plus 150 is 220 which is congruent to −140 modulo 360 and −140 is in the range between −180 and 180.

Mapping preset 163 may be used to select which function is used for remapping or which static mapping vector templates. Examples include:

| mapping preset 0 (disabled) | | | | | | | | | | | | | |
|---|---|---|---|---|---|---|---|---|---|---|---|---|---|
| Input | −180 | −150 | −120 | −90 | −60 | −30 | 0 | 30 | 60 | 90 | 120 | 150 | 180 |

| mapping preset 1 (narrow beam) | | | | | | | | | | | | | |
|---|---|---|---|---|---|---|---|---|---|---|---|---|---|
| Input | −180 | −150 | −120 | −90 | −60 | −40 | 0 | 40 | 60 | 90 | 120 | 150 | 180 |

| mapping preset 2 (wide beam) | | | | | | | | | | | | | |
|---|---|---|---|---|---|---|---|---|---|---|---|---|---|
| Input | −180 | −150 | −120 | −90 | −80 | −60 | 0 | 60 | 80 | 90 | 120 | 150 | 180 |

Moreover, dynamic generation of remapping vector may be supported with embodiments of the invention.

Figure 2:
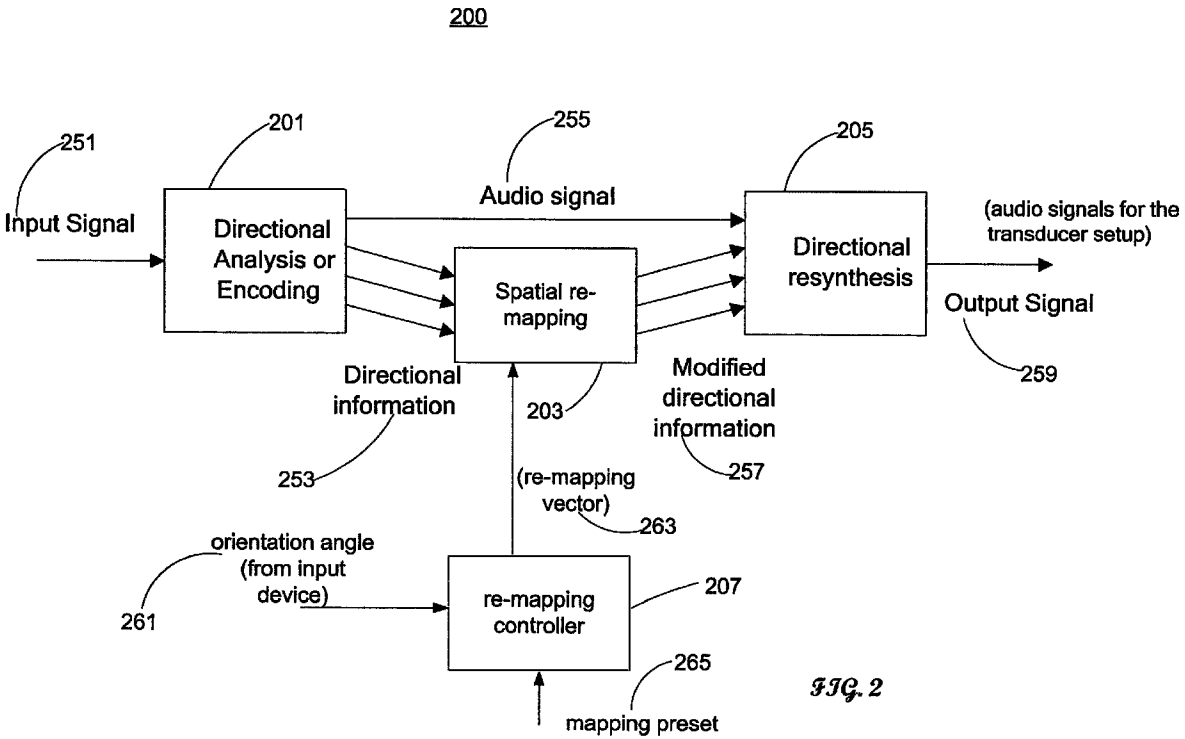
FIG. 2 shows an architecture for re-panning an audio signal according to an embodiment of the invention.

FIG. 2 shows architecture 200 for re-panning audio signal 251 according to an embodiment of the invention. (Panning is the spread of a monaural signal into a stereo or multi-channel sound field. With re-panning, a pan control typically varies the distribution of audio power over a plurality of loudspeakers, in which the total power is constant.)

Figure 4:
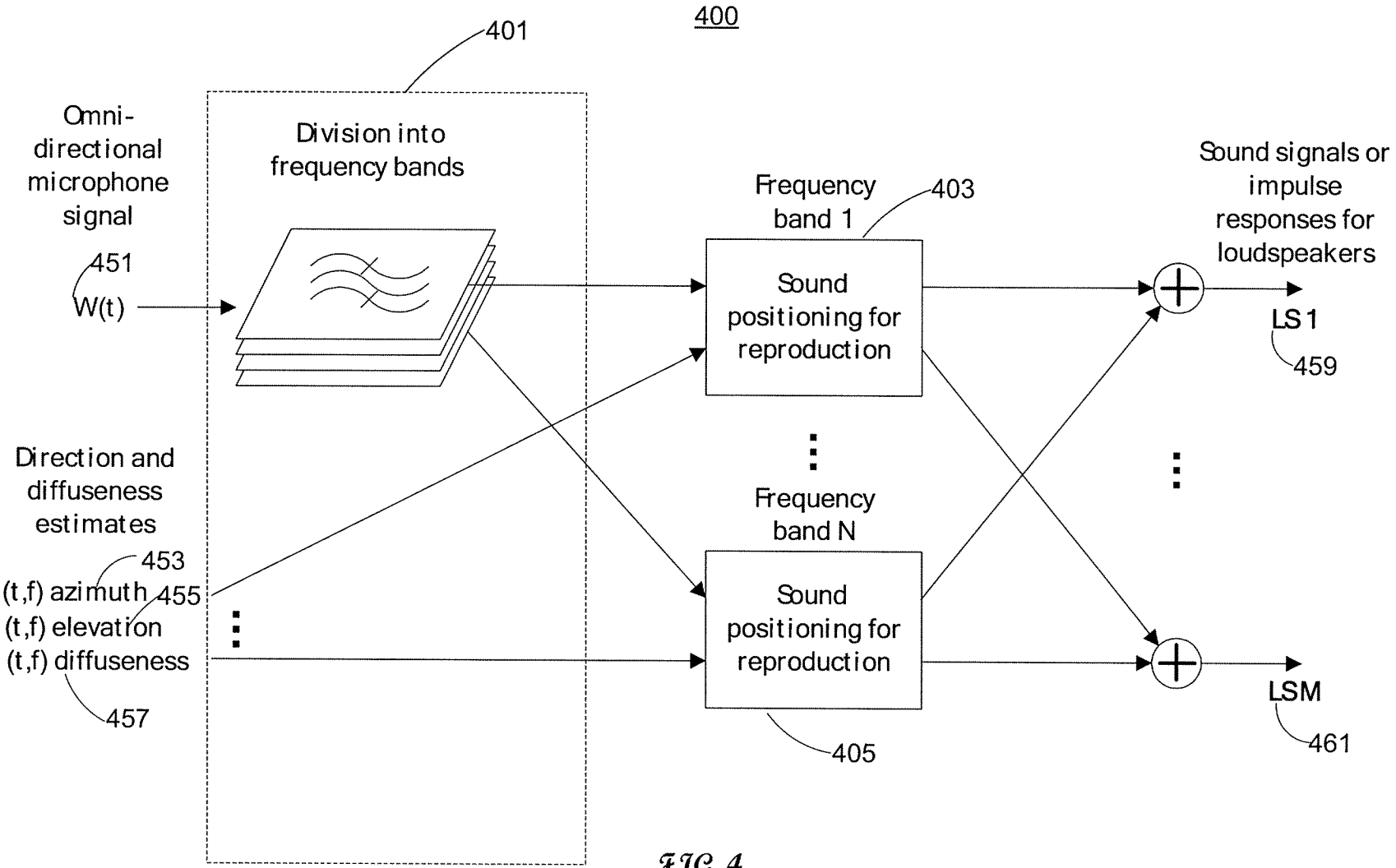
FIG. 4 shows an architecture for directional audio coding (DirAC) synthesis according to an embodiment of the invention.

Architecture 200 may be applied to systems that have knowledge of the spatial characteristics of the original sound fields and that may re-synthesize the sound field from audio signal 251 and available spatial metadata (e.g., directional information 253). Spatial metadata may be available by an analysis method (performed by module 201) or may be included with audio signal 251. Spatial re-panning module 203 subsequently modifies directional information 253 to obtain modified directional information 257. (As shown in FIG. 4, directional information may include azimuth, elevation, and diffuseness estimates.)

Directional re-synthesis module 205 forms re-panned signal 259 from audio signal 255 and modified directional information 257. The data stream (comprising audio signal 255 and modified directional information 257) typically has a directionally coded format (e.g., B-format as will be discussed) after re-panning.

Moreover, several data streams may be combined, in which each data stream includes a different audio signal with corresponding directional information. The re-panned signals may then be combined (mixed) by directional re-synthesis module 205 to form output signal 259. If the signal mixing is performed by re-synthesis module 205, the mixed output stream may have the same or similar format as the input streams (e.g., audio signal with directional information). A system performing mixing is disclosed by U.S. patent application Ser. No. 11/478,792 ("DIRECT ENCODING INTO A DIRECTIONAL AUDIO CODING FORMAT", Jarmo Hiipakka) filed Jun. 30, 2006, which is hereby incorporated by reference. For example, two audio signals associated with directional information are combined by analyzing the signals for combining the spatial data. The actual signals are mixed (added) together. Alternatively, mixing may happen after the re-synthesis, so that signals from several re-synthesis modules (e.g. module 205) are mixed. The output signal may be rendered to a listener by directing an acoustic signal through a set of loudspeakers or earphones. With embodiments of the invention, the output signal may be transmitted to the user and then rendered (e.g., when processing takes place in conference bridge.) Alternatively, output is stored in a storage device (not shown).

Modifications of spatial information (e.g., directional information 253) may include remapping any range (2D) or area (3D) of positions to a new range or area. The remapped range may include the whole original sound field or may be sufficiently small that it essentially covers only one sound source in the original sound field. The remapped range may also be defined using a weighting function, so that sound sources close to the boundary may be partially remapped. Re-panning may also consist of several individual re-panning operations together. Consequently, embodiments of the invention support scenarios in which positions of two sound sources in the original sound field are swapped.

Spatial re-panning module 203 modifies the original azimuth, elevation and diffuseness estimates (directional information 253) to obtain modified azimuth, elevation and diffuseness estimates (modified directional information 257) in accordance with re-mapping vector 263 provided by re-mapping controller 207. Re-mapping controller 207 determines re-mapping vector 263 from orientation angle information 261, which is typically provided by an input device (e.g., a joystick, headtracker). Orientation angle information 261 specifies where the listener wants to focus attention. Mapping preset 265 is a control signal that specifies the type of mapping that will be used. A specific mapping describes which parts of the sound stage are spatially compressed, expanded, or unmodified. Several parts of the sound scene can be re-panned qualitatively the same way so that, for example, sources clustered around straight left and straight right are expanded whereas sources clustered around the front and the rear are compressed.

If directional information 253 contains information about the diffuseness of the sound field, diffuseness is typically processed by module 203 when re-panning the sound field. Consequently, it may be possible to maintain the natural character of the diffuse field. However, it is also possible to map the original diffuseness component of the sound field to a specific position or a range of positions in the modified sound field for special effects. For example, different diffuseness values may be used for the spatial region where the spatial focus is set than other regions. Diffuseness values may be changed according to function that depends on the direction where spatial focus attention is set.

To record a B-format signal, the desired sound field is represented by its spherical harmonic components in a single point. The sound field is then regenerated using any suitable number of loudspeakers or a pair of headphones. With a first-order implementation, the sound field is described using the zero$^{th}$-order component (sound pressure signal W) and three first-order components (pressure gradient signals X, Y, and Z along the three Cartesian coordinate axes). Embodiments of the invention may also determine higher-order components.

The first-order signal that consists of the four channels W, X, Y, and Z, often referred as the B-format signal. One typically obtains a B-format signal by recording the sound field using a special microphone setup that directly or through a transformation yields the desired signal.

Besides recording a signal in the B-format, it is possible to synthesize the B-format signal. For encoding a monophonic audio signal into the B-format, the following coding equations are required:

$$W(t) = \frac{1}{\sqrt{2}}x(t) \qquad \text{(EQ. 1)}$$
$$X(t) = \cos\theta\cos\varphi\, x(t)\,,$$
$$Y(t) = \sin\theta\cos\varphi\, x(t)$$
$$Z(t) = \sin\varphi\, x(t)$$

where x(t) is the monophonic input signal, θ is the azimuth angle (anti-clockwise angle from center front), ϕ is the elevation angle, and W(t), X(t), Y(t), and Z(t) are the individual channels of the resulting B-format signal. Note that the multiplier on the W signal is a convention that originates from the need to get a more even level distribution between the four channels. (Some references use an approximate value of 0.707 instead.) It is also worth noting that the directional angles can, naturally, be made to change with time, even if this was not explicitly made visible in the equations. Multiple monophonic sources can also be encoded using the same equations individually for all sources and mixing (adding together) the resulting B-format signals.

If the format of the input signal is known beforehand, the B-format conversion can be replaced with simplified computation. For example, if the signal can be assumed the standard 2-channel stereo (with loudspeakers at +/−30 degrees angles), the conversion equations reduce into multiplications with constants. Currently, this assumption holds for many application scenarios.

Embodiments of the invention support parameter space re-panning for multiple sound scene signals by applying spatial cue coding. Sound sources in each of the signals are re-panned before they are mixed to a combined signal. Processing may be applied, for example, in a conference bridge that receives two omni-directionally recorded (or synthesized) sound field signals, which then re-pans one of these to the listeners left side and the other to the right side. The source image mapping and panning may further be adaptively based on content and use. Mapping may be performed by manipulating the directional parameters prior to directional decoding or before directional mixing.

Figure 3:
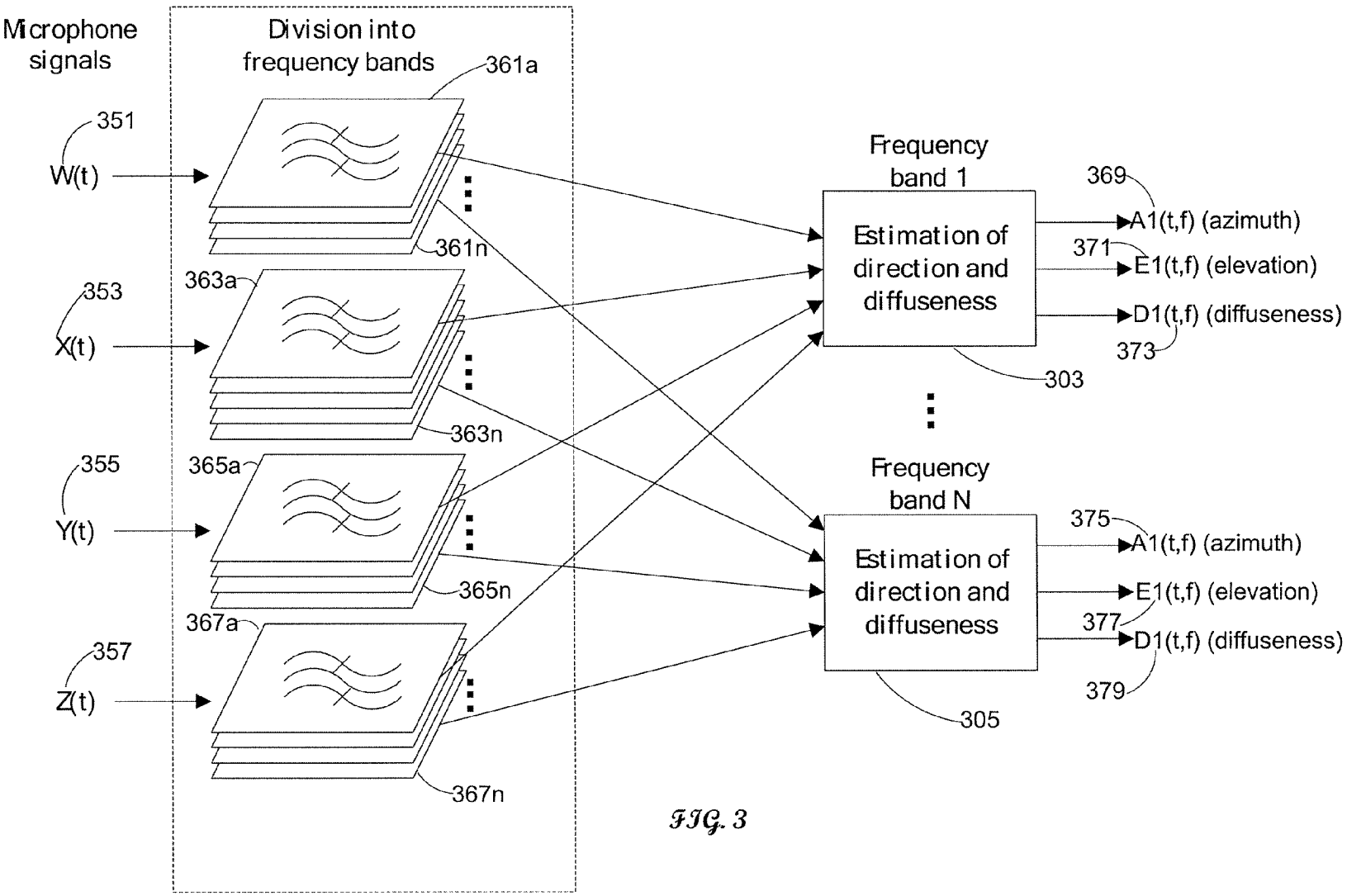
FIG. 3 shows an architecture for directional audio coding (DirAC) analysis according to an embodiment of the invention.

Embodiments of the invention support the following capabilities in a teleconferencing system:

Re-panning solves the problem of combining sound field signals from several conference rooms Realistic representation of conference participants Generic solution for spatial re-panning in parameter space FIG. 3 shows an architecture 300 for a directional audio coding (DirAC) analysis module (e.g., module 201 as shown in FIG. 2) according to an embodiment of the invention. With embodiments of the invention, in FIG. 2, DirAC analysis module 201 extracts the audio signal 255 and directional information 253 from input signal 251. DirAC analysis provides time and frequency dependent information on the directions of sound sources regarding the listener and the relation of diffuseness to direct sound energy. This information is then used for selecting the sound sources positioned near or on a desired axis between loudspeakers and directing them into the desired channel. The signal for the loudspeakers may be generated by subtracting the direct sound portion of those sound sources from the original stereo signal, thus preserving the correct directions of arrival of the echoes.

As shown in FIG. 3, a B-format signal comprises components W(t) 351, X(t) 353, Y(t) 355, and Z(t) 357. Using a short-time Fourier transform (STFT), each component is transformed into frequency bands 361*a*-361*n* (corresponding to W(t) 351), 363*a*-363*n* (corresponding to X(t) 353), 365*a*-365*n* (corresponding to Y(t) 355), and 367*a*-367*n* (corresponding to Z(t) 357). Direction-of-arrival parameters (including azimuth and elevation) and diffuseness parameters are estimated for each frequency band 303 and 305 for each time instance. As shown in FIG. 3, parameters 369-373 correspond to the first frequency band, and parameters 375-379 correspond to the N$^{th}$ frequency band.

FIG. 4 shows an architecture 400 for a directional audio coding (DirAC) synthesizer (e.g., directional re-synthesis module 205 as shown in FIG. 2) according to an embodiment of the invention. Base signal W(t) 451 is divided into a plurality of frequency bands by transformation process 401. Synthesis is based on processing the frequency components of base signal W(t) 451. W(t) 451 is typically recorded by the omni-directional microphone. The frequency components of W(t) 451 are distributed and processed by sound positioning and reproduction processes 405-407 according to the direction and diffuseness estimates 453-457 gathered in the analysis phase to provide processed signals to loudspeakers 459 and 461.

DirAC reproduction (re-synthesis) is based on taking the signal recorded by the omni-directional microphone, and distributing this signal according to the direction and diffuseness estimates gathered in the analysis phase.

DirAC re-synthesis may generalize a system by supporting the same representation for the sound field and use an arbitrary loudspeaker (or transducer, in general) setup in reproduction. The sound field may be coded in parameters that are independent of the actual transducer setup used for reproduction, namely direction of arrival angles (azimuth, elevation) and diffuseness.

Figure 5:
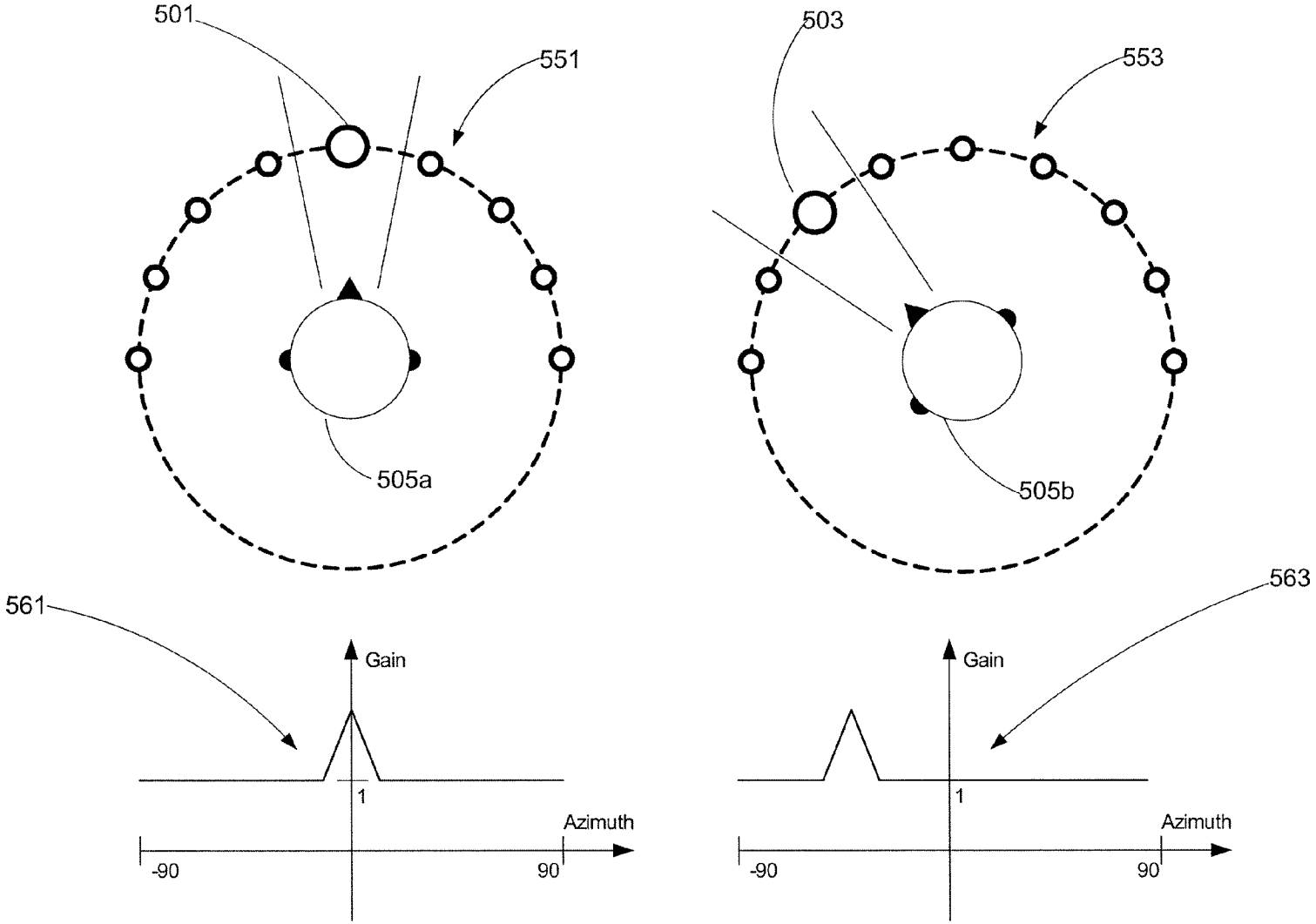
FIG. 5 shows a scenario for a listener facing an acoustic source in order to focus on the sound source according to an embodiment of the invention.

FIG. 5 shows scenarios 551 and 553 for listener 505*a*,505*b* facing an acoustic source in order to focus on the sound source (e.g., acoustic source 501 or 503) according to an embodiment of the invention. The user (505*a*,505*b*) can control the spatial attention through an input device. The input device can be of a type commonly used in mobile devices, such as a keypad or a joystick, or it can use sensors such as accelerometers, magnetometers, or gyros to detect the user's movement. A headtracker, for example, can direct attention to a certain part of the sound stage according to the direction in which the listener is facing as illustrated in FIG. 5. The desired direction (spatial attention angle) can be linearly or nonlinearly dependent on the listeners head orientation. With some embodiments, it may be more convenient to turn head only 30 degrees to set the spatial attention to 90 degrees. A backwards tilt can determine the gain applied to the selected part of the sound scene. With headtracking, the direction control of spatial attention control may be switched on and off, for example, by pressing a button. Thus, spatial attention can be locked to certain position. With embodiment of the invention, it may be advantageous in a 3D teleconferencing session to give a constant boost to a certain participant who has weaker voice than the others.

If desired, the overall loudness can be preserved by attenuating sounds localized outside the selected part of the sound scene as shown by gain functions 561 (corresponding to scenario 551) and 563 (corresponding to scenario 553).

Figure 6:
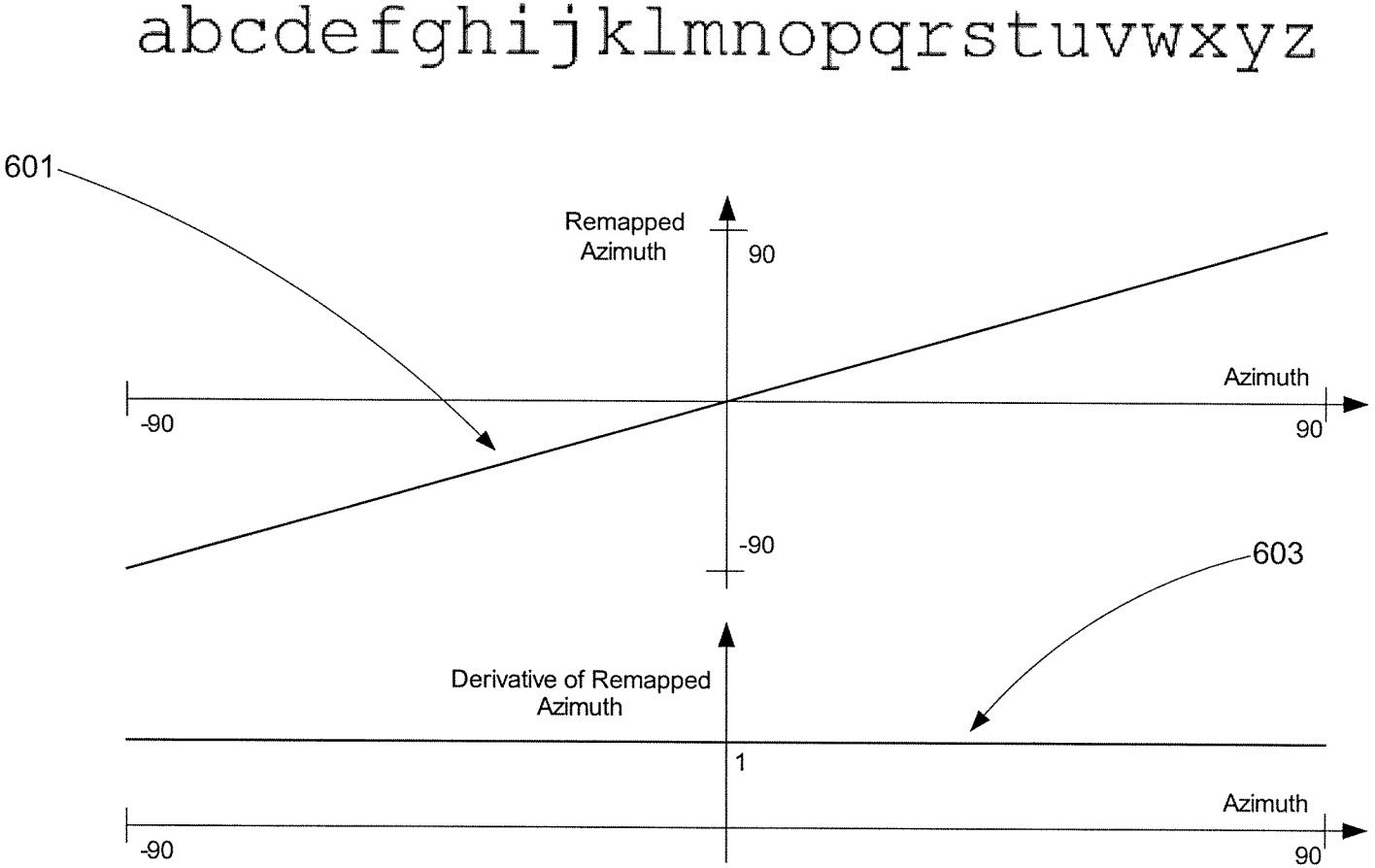
FIG. 6 shows a linear re-mapping function according to an embodiment of the invention.

FIG. 6 shows linear re-mapping function 601 according to an embodiment of the invention. The linear re-mapping function 601 does not change the positions of any of the audio sources in the audio scene since the relationship between the original azimuth, and the remapped azimuth is linear with a slope of one (as shown in derivative function 603).

Figure 7:
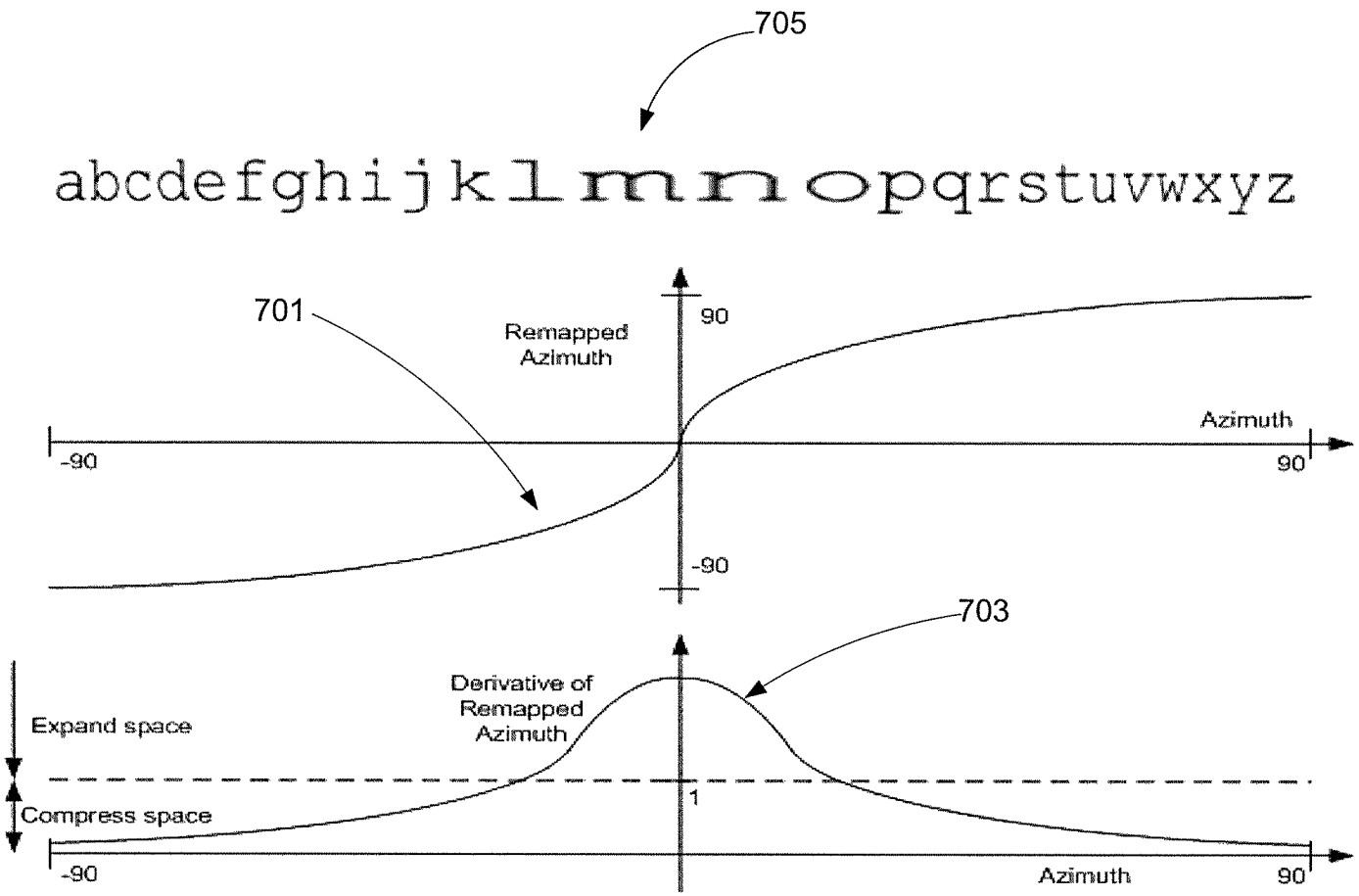
FIG. 7 shows a non-linear re-mapping function according to an embodiment of the invention.

FIG. 7 shows non-linear re-mapping function 701 according to an embodiment of the invention. When the audio scene is transformed spatially, the relationship is no longer linear. A derivative greater than one (as shown with derivative function 703) is equivalent to an expansion of space whereas a derivative smaller than one means is equivalent to a compression of space. This is illustrated in FIG. 7 where the graphical representation of the alphabet 705 (which represents compression and expansion about different audio sources, where the letters of the alphabet represent the audio sources) at the top indicates that the letters near an azimuth of zero are stretched and the letters near plus and minus 90 degrees are squeezed together.

With embodiment of the invention, audio processing module 3 (as shown in FIG. 1A) utilizes re-mapping function (e.g., function 701) to alter the relationship of acoustic sources for the output multi-channel audio signal that is rendered to the listener.

FIG. 8 shows scenarios 851, 853, and 855 for focusing on an acoustic source according to an embodiment of the invention. When several audio sources are close to each other in an audio scene (e.g., sources 803, 804, and 805 in scenario 853 and sources 801, 802, and 803 in scenario 855), spatial focus processing with azimuth remapping can move audio sources away from each other so that intelligibility is improved during simultaneous speech with respect to the audio source that the listener wishes to focus on. In addition, it may become easier to recognize which person is talking since the listener is able to order reliably the talkers from left to right.

With discrete speech input signals, re-mapping may be implemented by controlling the locations where individual sound sources are spatialized. In case of a multi-channel recording with spatial content, re-panning can be implemented using a re-panning approach or by using an up-mixing approach.

Figure 9:
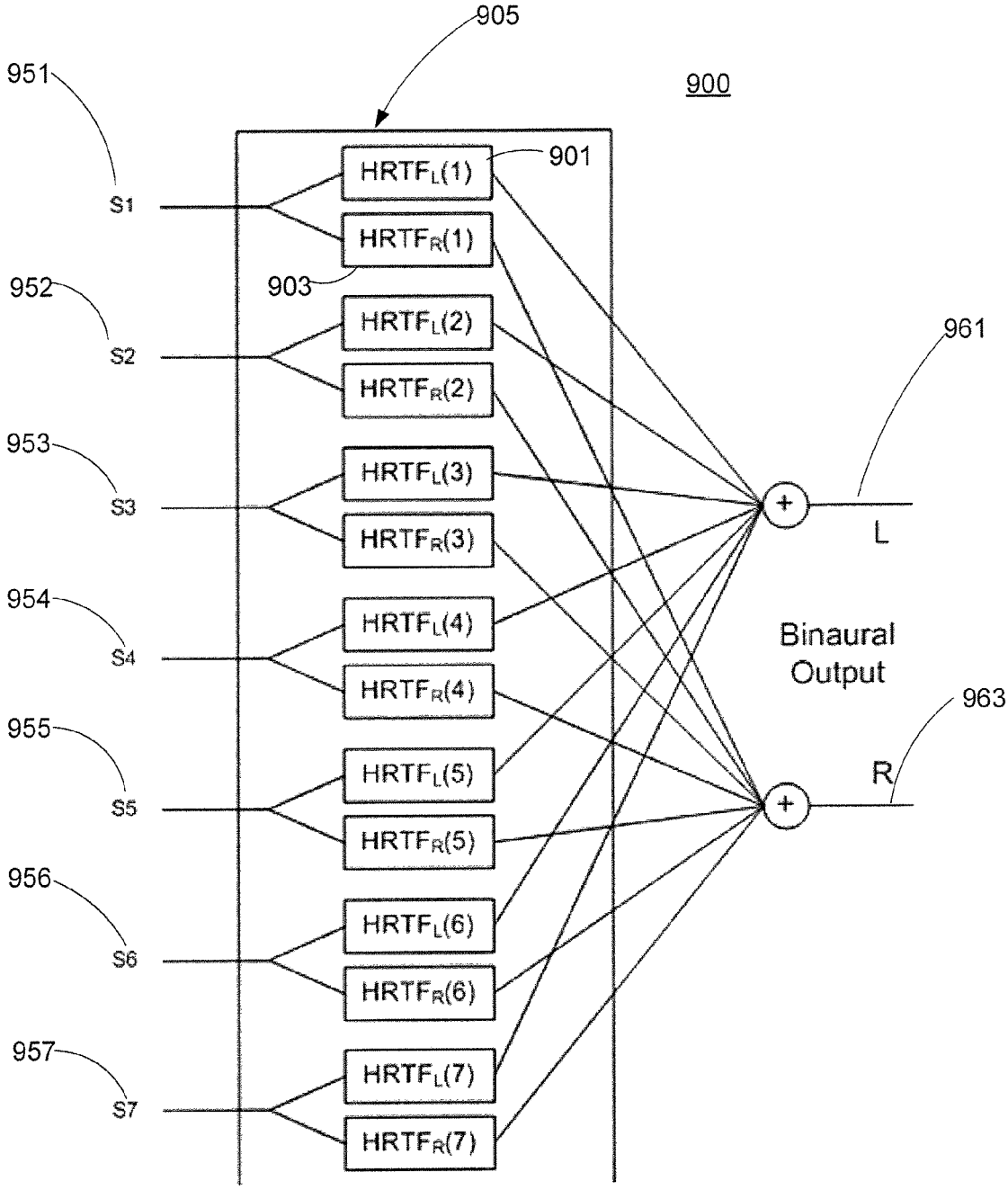
FIG. 9 shows a bank of filters for processing a multi-channel audio signal according to an embodiment of the invention.

FIG. 9 shows a bank of filters 905 for processing a multi-channel audio signal according to an embodiment of the invention. The multi-channel audio signal comprises signal components 951-957 that are generated by corresponding audio sources. The bank of filters include head-related transfer function (HRTF) filters 901 and 903 that process the signal component 951 for left channel 961 and right channel 963, respectively, of the binaural output that is played to the listener through headphones, loudspeakers, or other suitable transducers. Bank of filters 905 also include additional HRTF filters for the other signal components.

For an example as illustrated by FIG. 9, audio signals are generated by seven participants that are spatialized for one remote listener, where each of the seven speech signals is available separately. Each speech signal is processed with a pair of head-related transfer functions (HRTF's) in order to produce a two-channel binaural output. The seven signals are then mixed together by including all of the left outputs into one channel (left channel 961) and all of the right outputs into the other channel (right channel 963). The HRTF's are implemented as digital filters whose properties correspond to the desired position of the spatialized source. A possible default mapping may place the seven spatialized sources evenly distributed across the sound stage, from −90 degrees azimuth (straight left) to 90 degrees azimuth (straight right). Referring to FIG. 8, when the listener wants to focus on a particular source in the audio scene, e.g., source 804, which is directly in front, the digital filters that implement the HRTFs are updated with the new positions. From left to right, the azimuths (in degrees) become (−90 −70 −50 0 50 70 90). If the listener now decides to focus on source 802, the azimuths become (−90 −45 0 22.5 45 67.5 90). Thus, the signal processing structure remains the same, but the filter parameters within the structure must be updated according to the desired spatial remapping.

As another example, referring to FIGS. 2 and 8, incoming audio signal 251 is in directional audio (DirAC) format (mono audio channel with spatial parameters). When listener wants to focus on source 802, new mapping pattern is generated to create modified directional information 257 and provide it to spatial repanning module 203. In this case, audio sources that would have been mapped to (−90 −30 −60 0 60 30 90) without repanning, could be mapped e.g., to azimuth positions (−90 −70 −50 0 50 70 90). When the listener changes focus, a new mapping pattern is used to produce different modified directional information 257. This may include modifying the diffuseness values as well, for example by using less diffuseness for those frequency bands that are positioned in the area where the listener has focused the attention. Diffuseness modification can be used to provide clearer (drier) sound from this direction.

Figure 10:
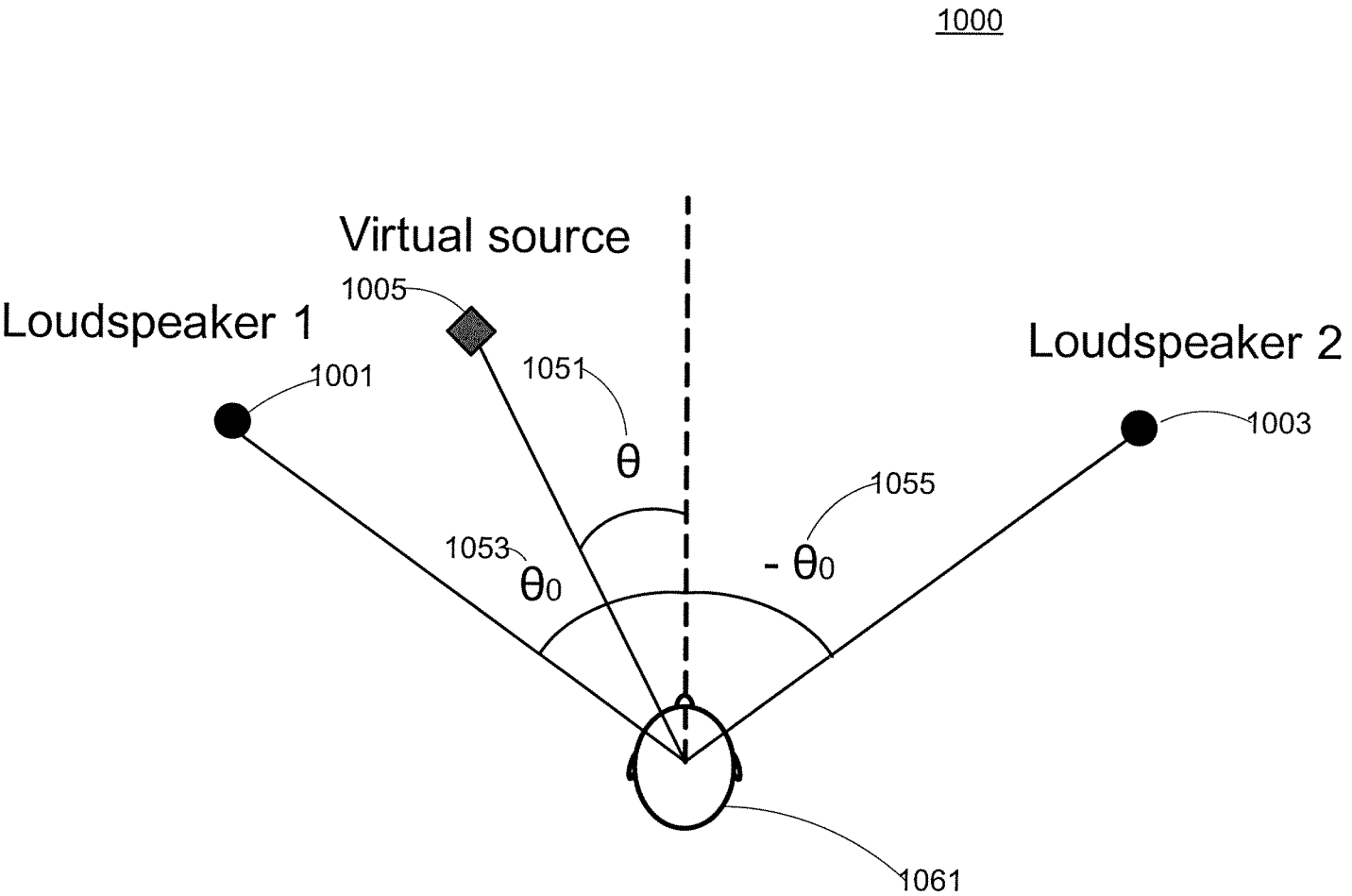
FIG. 10 shows an example of positioning of a virtual sound source in accordance with an embodiment of the invention.

FIG. 10 shows an example of positioning of virtual sound source 1005 in accordance with an embodiment of the invention. Virtual source 1005 is located between loudspeakers 1001 and 1003 as specified by separation angles 1051-1055. (Embodiments of the invention also support stereo headphones, where one side corresponds to loudspeaker 1001 and the other side corresponds to loudspeaker 1003.) The separation angles, which are measured relative to listener 1061, are used to determine amplitude panning. When the sine panning law is used, the amplitudes for loudspeakers 1001 and 1003 are determined according to the equation $$\frac{\sin\theta}{\sin\theta_0} = \frac{g_1 - g_2}{g_1 + g_2} \quad \text{(EQ. 2)}$$

where $g_1$ and $g_2$ are the ILD values for loudspeakers 1001 and 1003, respectively. The amplitude panning for virtual center channel (VC) using loudspeakers Ls and Lf is thus determined as follows $$\frac{\sin((\theta_{C1} + \theta_{C2})/2 - \theta_{C1})}{\sin((\theta_{C1} + \theta_{C2})/2)} = \frac{g_{Ls} - g_{Lf}}{g_{Ls} + g_{Lf}} \quad \text{(EQ. 3)}$$

Figure 11:
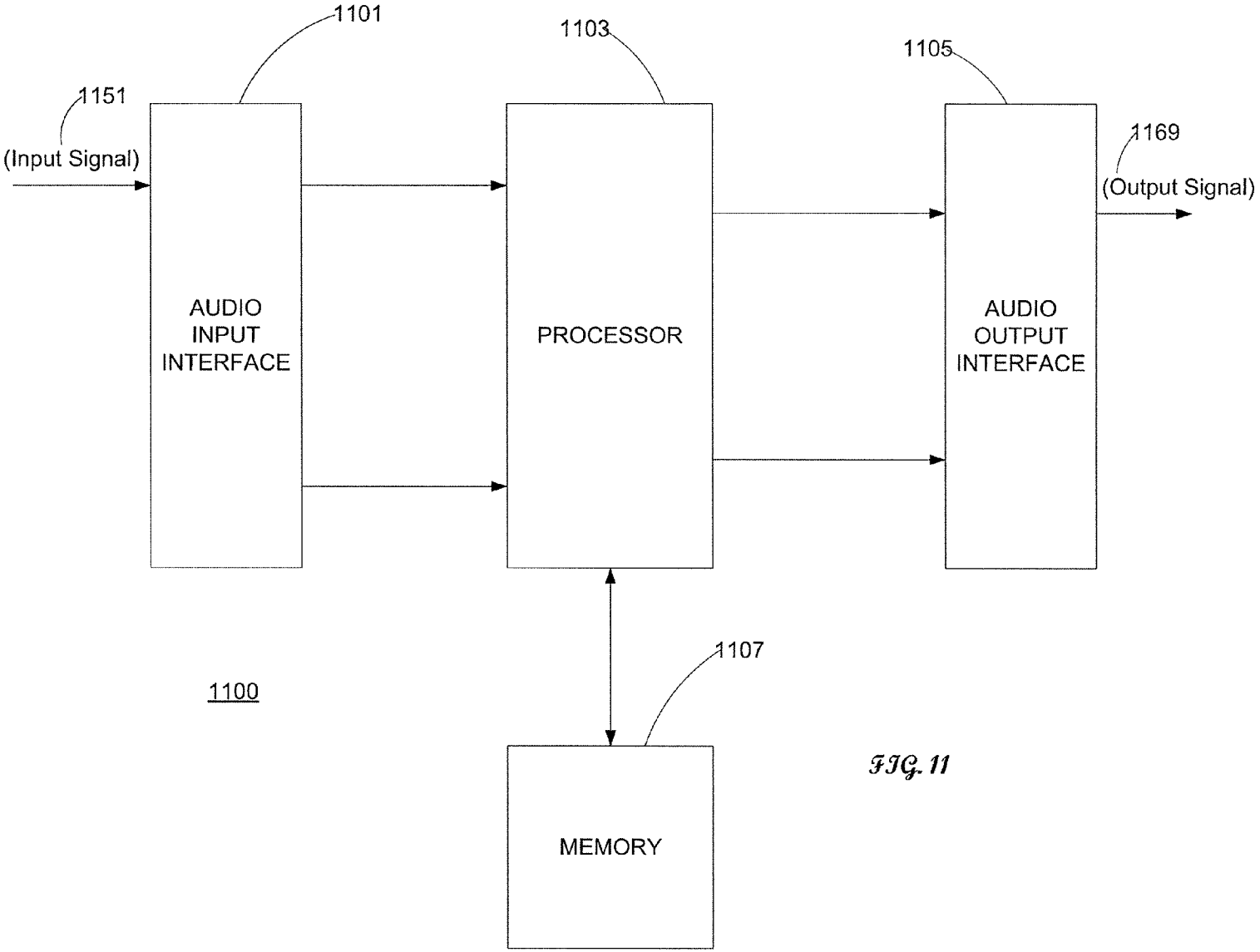
FIG. 11 shows an apparatus for re-panning an audio signal according to an embodiment of the invention.

FIG. 11 shows an apparatus 1100 for re-panning an audio signal 1151 to re-panned output signal 1169 according to an embodiment of the invention. (While not shown in FIG. 11, embodiments of the invention may support 1 to N input signals.) Processor 1103 obtains input signal 1151 through audio input interface 1101. With embodiments of the invention, signal 1151 may be recorded in a B-format, or audio input interface may convert signals 1151 in a B-format using EQ. 1. Modules 1 and 3 (as shown in FIG. 1A) may be implemented by processor 1103 executing computer-executable instructions that are stored on memory 1107. Processor 1103 provides combined re-panned signal 1169 through audio output interface 1105 in order to render the output signal to the user.

Apparatus 1100 may assume different forms, including discrete logic circuitry, a microprocessor system, or an integrated circuit such as an application specific integrated circuit (ASIC).

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method comprising:

obtaining a single-channel or multi-channel input audio signal having a plurality of audio sources;

generating, with a processor, a single-channel or multi-channel output audio signal including the plurality of audio sources spatialized in a sound field;

obtaining at least one parameter from a user controlled input device, the at least one parameter indicating at least one direction of spatial attention in the sound field; and expanding a first region of the sound field around the indicated at least one direction of spatial attention to produce a modified sound field in the output audio signal to a user, wherein the expanding includes:

for any sound source in the first region and not centered in the indicated at least one direction of spatial attention in the sound field, moving the sound source in the modified sound field according to a re-mapping function; and for any sound source centered in the indicated at least one direction of spatial attention in the sound field, maintaining the sound source centered in the indicated at least one direction of spatial attention in the modified sound field.

2. The method of claim 1, further comprising:

compressing a second region of the sound field to produce the modified sound field.

3. The method of claim 1, further comprising:

re-mapping an azimuth value of each sound source in the first region and not centered in the indicated at least one direction of spatial attention to a new azimuth value in the modified sound field.

4. The method of claim 1, further comprising:

utilizing a remapping function to re-map each azimuth value, wherein the re-mapping function is characterized by a non-linearity and has a derivative greater than one for a range of possible new azimuth values.

5. The method of claim 1, further comprising:

preserving an overall loudness of the plurality of audio sources when moving one or more of the plurality of audio sources in the modified sound field of the output audio signal.

6. The method of claim 1, further comprising:

amplifying one or more of the audio sources positioned within the first region of the sound field.

7. The method of claim 1, the output audio signal comprising a binaural audio signal.

8. The method of claim 1, further comprising:

obtaining the at least one parameter indicating the at least one direction of spatial attention from a headtracker configured to be fastened to the user.

9. An apparatus comprising:

at least one processor;

and memory having computer executable instructions stored thereon, that when executed, cause the apparatus to:

obtain a single-channel or multi-channel input audio signal having a plurality of audio sources;

generate a single-channel or multi-channel output audio signal including the plurality of audio sources spatialized in a sound field;

obtain at least one parameter from a user controlled input device, the at least one parameter indicating at least one direction of spatial attention in the sound field; and expand a first region of the sound field around the indicated at least one direction of spatial attention to produce a modified sound field in the output audio signal to a user, wherein the expanding includes:

for any sound source in the first region and not centered in the indicated at least one direction of spatial attention in the sound field, move the sound source in the modified sound field according to a re-mapping function; and for any sound source centered in the indicated at least one direction of spatial attention in the sound field, maintain the sound source centered in the indicated at least one direction of spatial attention in the modified sound field.

10. The apparatus of claim 9, wherein the computer executable instructions, when executed, cause the apparatus to:

compress a second region of the sound field to produce the modified sound field.

11. The apparatus of claim 9, wherein the computer executable instructions, when executed, cause the apparatus to:

re-map an azimuth value of each sound source in the first region and not centered in the indicated at least one direction of spatial attention to a new azimuth value in the modified sound field.

12. The apparatus of claim 11, wherein the computer executable instructions, when executed, cause the apparatus to:

utilize a re-mapping function to re-map each azimuth value, wherein the re-mapping function is characterized by a non-linearity and has a derivative greater than one for a range of possible new azimuth values.

13. A method comprising:

obtaining a single-channel or multi-channel input audio signal having a plurality of audio sources;

generating a single-channel or multi-channel output audio signal including the plurality of audio sources spatialized in a sound field;

obtaining at least one parameter from a user control led in gut device, the at least one parameter indicating at least one direction of spatial attention in the sound field; and expanding a first region of the sound field around the indicated at least one direction of spatial attention to produce a modified sound field in the output audio signal to a user, wherein the expanding includes:

for each sound source in the first region, modifying in the modified sound field an azimuth angle between the sound source and the indicated at least one direction of spatial attention according to a re-mapping function having a non-zero derivative at the indicated at least one direction of spatial attention.

14. The method of claim 13, further comprising:

compressing a second region of the sound field to produce the modified sound field.

15. The method of claim 13, wherein the re-mapping function is characterized by a non-linearity and has a derivative greater than one for a range of possible new azimuth values.

16. An apparatus comprising:

at least one processor;

and memory having computer executable instructions stored thereon, that when executed, cause the apparatus to:

obtain a single-channel or multi-channel audio signal having a plurality of audio sources;

generate a single-channel or multi-channel output audio signal including the plurality of audio sources spatialized in a sound field;

obtain at least one parameter from a user controlled input device, the at least one parameter indicating at least one direction of spatial attention in the sound field; and expand a first region of the sound field around the indicated at least one direction of spatial attention to produce a modified sound field in the output audio signal to a user, wherein the expanding includes:

for each sound source in the first region, modifying in the modified sound field an azimuth angle between the sound source and the indicated at least one direction of spatial attention according to a re-mapping function having a non-zero derivative at the indicated at least one direction of spatial attention.

17. The apparatus of claim 16, wherein the computer executable instructions, when executed, cause the apparatus to:

compress a second region of the sound field to produce the modified sound field.

18. The method of claim 1, further comprising:

determining directional information for each of the plurality of audio sources in the input audio signal; and generating the output audio signal by positioning the plurality of audio sources in the sound field based on the directional information.

19. The apparatus of claim 9, wherein the computer executable instructions, when executed, cause the apparatus to:

determine directional information for each of the plurality of audio sources in the input audio signal; and generate the output audio signal by positioning the plurality of audio sources in the sound field based on directional information.

20. The method of claim 1, further comprising:

rendering the output audio signal from one or more speakers.

21. The apparatus of claim 9, wherein the computer executable instructions, when executed, cause the apparatus to:

render the output audio signal from one or more speakers.

22. The method of claim 1, further comprising:

for any sound source in the first region and not centered in the indicated at least one direction of spatial attention in the sound field, moving the sound source in the modified sound field away from the at least one direction of spatial attention according to the re-mapping function.

* * * * *

UNITED STATES PATENT AND TRADEMARK OFFICE

CERTIFICATE OF CORRECTION

PATENT NO. : 8,509,454 B2
APPLICATION NO. : 11/933638
DATED : August 13, 2013
INVENTOR(S) : Ole Kirkeby et al.

It is certified that error appears in the above-identified patent and that said Letters Patent is hereby corrected as shown below:

In the Claims

Column 15, Claim 13, Lines 42 and 43:

Please delete "control led in gut device," and insert --controlled input device,--.

Signed and Sealed this
Twenty-fourth Day of December, 2013

Margaret A. Focarino

Margaret A. Focarino
*Commissioner for Patents of the United States Patent and Trademark Office*